US005134113A

United States Patent [19]

Klug et al.

[11] Patent Number: 5,134,113

[45] Date of Patent: Jul. 28, 1992

[54] THERMOREACTIVE RECORDING MATERIAL

[75] Inventors: Günter Klug, Monheim; Hubertus Psaar, Leverkusen; Siegfried Korte, Odenthal, all of Fed. Rep. of Germany

[73] Assignee: Bayer Aktiengesellschaft, Leverkusen, Fed. Rep. of Germany

[21] Appl. No.: 546,460

[22] Filed: Jun. 29, 1990

[30] Foreign Application Priority Data

Jul. 11, 1989 [DE] Fed. Rep. of Germany ..... 3922766

[51] Int. Cl.[5] ..... B41M 5/30

[52] U.S. Cl. ..... 503/216; 427/150; 503/225

[58] Field of Search ..... 427/150, 151; 503/216, 503/225

[56] References Cited

U.S. PATENT DOCUMENTS

| | | | |
|---|---|---|---|
| 3,825,432 | 7/1974 | Futaki et al. | 106/21 |
| 4,600,930 | 7/1986 | Psaar | 503/201 |
| 4,719,198 | 1/1988 | Sato et al. | 503/209 |
| 4,918,048 | 4/1990 | Psaar et al. | 503/216 |

FOREIGN PATENT DOCUMENTS

| | | | |
|---|---|---|---|
| 066813 | 12/1982 | European Pat. Off. | 503/209 |
| 0138159 | 4/1985 | European Pat. Off. | 503/201 |
| 2110859 | 9/1971 | Fed. Rep. of Germany | 106/21 |
| 3715724 | 11/1988 | Fed. Rep. of Germany | 503/216 |
| 61-297173 | 12/1986 | Japan . | |

*Primary Examiner*—Bruce H. Hess

*Attorney, Agent, or Firm*—Sprung, Horn Kramer & Woods

[57] ABSTRACT

Thermoreactive recording material contains, as developer, a mixture of an acidic-modified polymer of (meth-)acrylonitrile and/or methacrylonitrile and a diphenol of the formula

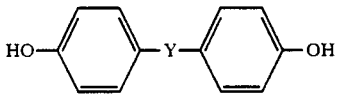

(I)

in which

Y is, for example, a single bond, an alkylene or alkylidene radical, gives, on thermal printing, a dye which has a reduced tendency to sublime.

2 Claims, No Drawings

THERMOREACTIVE RECORDING MATERIAL

The invention relates to a thermoreactive recording material composed essentially of a base material to which a colourless dye-forming component and an acidic developer are applied.

The material is characterized in that it contains as developer a mixture of an acidic-modified polymer of acrylonitrile and/or methacrylonitrile and a diphenol of the formula

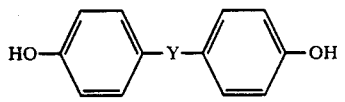

(I)

in which

Y is a single bond, an alkylene or alkylidene radical having 1–7 carbon atoms, a cycloalkylene or cycloalkylidene radical having 5–12 carbon atoms, —O—, —S—,

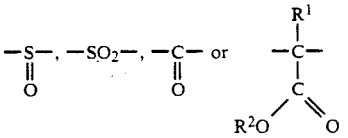

where $R^1/R^2$=alkyl, cycloalkyl, aralkyl or aryl, and also the ring-alkylated and ring-halogenated derivatives thereof.

Suitable alkyl radicals (also in the "rings"), are those having 1–4 carbon atoms, preference being given to methyl.

Suitable cycloalkyl radicals are cyclohexyl radicals. Suitable aralkyl radicals are benzyl radicals. Suitable aryl radicals are phenyl radicals which are optionally substituted by Cl or $CH_3$.

"Halogen" is preferably understood to mean chlorine.

Examples of compounds of the formula I are:
dihydroxybiphenyls,
bis(hydroxyphenyl)alkanes,
bis(hydroxyphenyl)cycloalkanes,
bis(hydroxyphenyl) sulphides,
bis(hydroxyphenyl) ethers,
bis(hydroxyphenyl) ketones,
bis(hydroxyphenyl) sulphoxides,
bis(hydroxyphenyl) sulphones and
α,α'-bis(hydroxyphenyl)diisopropylbenzenes
and also the ring-alkylated and ring-halogenated derivatives thereof.

Suitable polymers of acrylonitrile and/or methacrylonitrile are those which contain acidic groups capable of developing the dye precursors and which have a high affinity towards the liberated dyes.

Suitable polymers are homopolymers and copolymers of acrylonitrile and methacrylonitrile with other vinyl compounds, these copolymers having at least 60 mol % of (meth)acrylonitrile units.

Examples of suitable comonomers are: vinylidene cyanide, vinyl fluoride, vinylpyridine, vinylimidazole, vinylpyrrolidone, alkyl acrylates and methacrylates, acrylamides and methacrylamides, vinyl esters of carboxylic acids, olefinically unsaturated mono- and di-carboxylic acids, olefinically unsaturated sulphonic acids and alkylbenzenesulphonic acids and the salts and esters thereof.

The polymers contain acidic groups, preferably sulphonate and sulphate groups.

Polymers of this type have been comprehensively described, for example in DE-A 3,715,724.

Polymers of this type are obtained by polymerization of

60–95, in particular 70–90, mol % of acrylonitrile and/or methacrylonitrile,

4–25, mol of (cyclo)alkyl acrylates and/or (cyclo)alkyl methacrylates and/or vinyl esters of carboxylic acids, 0–10, in particular 1.5–7, mol % of an olefinically unsaturated carboxylic acid and 0.5–10, in particular 0.5–3, mol % of sulphonate-, sulpho- and/or sulphonyl ester-containing comonomers.

The total proportion of acidic groups in the preferred polymer is at least 200, preferably at least 400 m equivalent/kg of polymer.

The solution viscosity $\mu_{rel}$ (0.5% in DMF) are preferably 1.0–6.0. This corresponds to K-values of 10–150.

Moreover, customary polyacrylonitriles, as used in textile fibre production, are suitable. These polymers contain only about 0.1–1%, preferably 0.3–0.6% of acidic groups (%=mol %).

The amount of diphenols added is 10–50% by weight, relative to the acrylonitrile polymer used.

The dye precursors which are to be used are the dye-forming components normally used for printing and thermocopying applications, with the exception of those which can only be converted into dyes by air-oxidation.

Examples of compounds of this type are carbinol bases and carbinol base derivatives of diaryl- and triaryl-methane dyes and fluorans.

The heat-sensitive materials, for example paper, are prepared by grinding the acidic-modified acrylonitrile polymers together with a diphenol of the formula (I) and together or separately with a binder, for example polyvinyl alcohol, hydroxyethylcellulose, gum arabic, polyvinylpyrrolidone or casein.

The polymer and the diphenol may also be ground separately and the dispersions later mixed together.

Improved dye formation is advantageously obtained by adding to the polymers so-called sensitizers such as aromatic suphonamides, carboxamides, anilides, p-hydroxybenzoyl esters, p-hydroxyterephthaloyl esters, diphenyl sulphones, p-benzylbiphenyls, phenylsalicylyl esters, dibenzyl terephthalates and dibenzyl isophthalates in amounts of 0.1 to 200%, relative to the polymer.

Sensitizers of this type are described, for example in JP-A-57/191,089, 58/98,285, 58/205,793, 58/205,795, 58/209,591, 58/209,592, 58/211,493, 58/211,494 and 59/9,092.

It is also possible to treat, for example, grind, the polymer with the additives beforehand. The colour developers are ground separately with the binders. The dispersions of the acceptor are mixed with the dispersions of the colour developer, and are applied using a doctor blade to the base material, preferably cellulose paper, and dried, so that the add-on is 5 to 8 g per $m^2$. Depending on the reactivity of the colour developer, it is also possible to grind the polymer and the colour developer together with the binder and to apply this mixture as described. Moreover, it is possible to stabilize the colour formers by adding bases, for example aliphatic amines or carbonates.

In another method of operation, it is also possible to produce the thermoreactive paper from a mixture of an acrylonitrile polymer with diphenol and the additives described above with cellulose, glue and aluminium sulphate in a sheet former and to coat this paper with the colour former.

Surprisingly, the combination according to the invention of diphenols and acrylonitrile polymers also reduces the tendency of the dye which has been formed to sublime.

The percentages given in the example are percentages by weight.

EXAMPLE

A ball mill is used to grind 35 g of a finely pulverulent polyacrylonitrile polymer prepared from 94% of acrylonitrile, 0.5% of methallylsulphonic acid and 5.5% of methyl acrylate, with 14 g of bisphenol A, 41 g of benzenesulphoanilide, 3.5 g of $CaCl_2$ and 275 g of a 2% strength aqueous solution of polyvinyl alcohol, with the addition of 1.3 g of distearyl hydrogenphosphate. A second dispersion is prepared from 50 g of a colour former of the formula

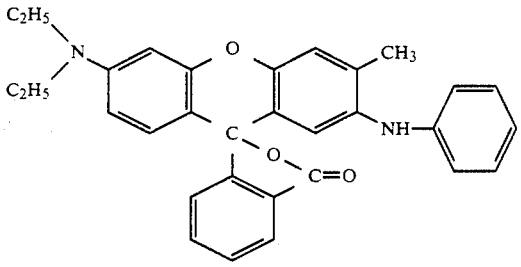

and 250 g of an 8% strength aqueous solution of polyvinyl alcohol. The dispersion of the colour former is mixed with that of the developer in the ratio of 7:72, the pH is adjusted to 9 and the mixture is applied to cellulose paper using a doctor blade, and dried, so that an add-on of 6–7 g/m$^2$ results. A heated scribe gives, on the sheet of paper, an intense black script which has a high resistance to fats and plasticizers.

We claim:

1. Thermoreactive recording material composed essentially of a base material to which a colorless dye-forming component and an acidic developer are applied, characterized in that it contains as developer a mixture of an acidic-modified polymer of acrylonitrile and/or methacrylonitrile and a diphenol of the formula

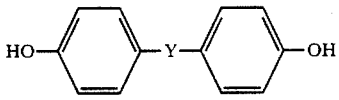

(I)

in which

Y is a single bond, an alkylene or alkylidene radical having 1–7 carbon atoms, a cycloalkylene or cycloalkylidene radical having 5–12 carbon atoms, —O—, —S—,

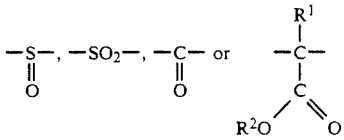

where $R^1/R^2$=alkyl, cycloalkyl, aralkyl or aryl, and also derivatives thereof wherein each ring of the diphenol of formula I is independently $C_1$–$C_4$ alkyl substituted or chlorine substituted.

2. Thermoreactive recording material according to claim 1, characterized in that the diphenol it contains is the compound of the formula

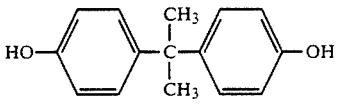

* * * * *

UNITED STATES PATENT AND TRADEMARK OFFICE

CERTIFICATE OF CORRECTION

PATENT NO. : 5,134,113

DATED : July 28, 1992

INVENTOR(S) : Klug et al.

It is certified that error appears in the above-identified patent and that said Letters Patent is hereby corrected as shown below:

Col. 2, line 50 Delete " suphonamides " and substitute -- sulphonamides --

Signed and Sealed this

Second Day of November, 1993

Bruce Lehman

*Attest:*

BRUCE LEHMAN

*Attesting Officer*

*Commissioner of Patents and Trademarks*